US005137041A

United States Patent [19]

Hall

[11] Patent Number: 5,137,041

[45] Date of Patent: Aug. 11, 1992

[54] DISHWASHER WITH FILL WATER CONTROL

[75] Inventor: Jon D. Hall, Saginaw, Mich.

[73] Assignee: Glastender, Inc., Saginaw, Mich.

[21] Appl. No.: 586,143

[22] Filed: Sep. 21, 1990

[51] Int. Cl.[5] ..... B08B 3/02

[52] U.S. Cl. ..... 134/57 D; 134/58 D; 134/105; 134/186

[58] Field of Search ..... 134/56 D, 57 D, 58 D, 134/105, 56 R, 57 R, 58 R, 107, 108, 106, 155

[56] References Cited

U.S. PATENT DOCUMENTS

| | | | |
|---|---|---|---|
| 1,558,276 | 10/1925 | Peterson . | |
| 1,995,331 | 3/1935 | Snyder et al. | 134/58 D |
| 2,024,952 | 12/1935 | Snyder et al. | 134/58 D |
| 2,214,844 | 9/1940 | Van Keuren et al. . | |
| 2,664,094 | 12/1953 | Spragins | 134/56 D X |
| 2,686,526 | 8/1954 | Frantz | 134/107 X |
| 2,691,986 | 10/1954 | Kirby | 134/107 X |
| 2,781,765 | 2/1957 | Steidley | 134/57 D |
| 3,064,664 | 11/1962 | Warhus | 134/58 D X |
| 3,415,261 | 12/1968 | Long | 134/57 D |
| 3,618,625 | 11/1971 | Walters . | |
| 3,896,827 | 7/1975 | Robinson | 134/56 D X |
| 4,254,788 | 3/1981 | Helwig, Jr. | 134/57 D |
| 4,456,024 | 6/1984 | Roberts . | |
| 4,557,252 | 12/1985 | Dinh . | |
| 4,657,038 | 4/1987 | Lyons . | |
| 4,689,089 | 8/1987 | Eberhardt, Jr. et al. | 134/56 D X |
| 4,765,351 | 8/1988 | Clary | 134/56 D |

FOREIGN PATENT DOCUMENTS

| | | | |
|---|---|---|---|
| 79962 | 10/1976 | Australia | 134/57 D |
| 514668 | 7/1955 | Canada | 134/58 D |
| 889373 | 2/1962 | United Kingdom | 134/58 D |
| 2113076 | 8/1983 | United Kingdom | 134/58 D |

*Primary Examiner*—Frankie L. Stinson

*Attorney, Agent, or Firm*—Learman & McCulloch

[57] ABSTRACT

A glass washer has a cabinet enclosing a water reservoir having a drain, a water inlet, a spray box, a motor driven rotary tray above the spray box, and a pump for causing water flow through the spray box to spray the contents of the tray. A control senses incoming water temperature and holds the drain open until the water temperature reaches a predetermined level and then closes the drain.

3 Claims, 3 Drawing Sheets

DISHWASHER WITH FILL WATER CONTROL

This invention relates to apparatus for controlling the delivery of fill water to a dishwasher, and more particularly to apparatus for ensuring the delivery of hot fill water.

BACKGROUND OF THE INVENTION

In restaurants and bars which require frequent washing of glasses and other dishes it is important to ensure that the water used by the washer is hot enough for satisfactory cleansing. One method of obtaining this result is to incorporate a heater in the washer. The use of a heater, however, adds to the initial cost of the machine as well as to the cost of maintenance.

Another, and simpler method of having hot water at the beginning of each wash period is to start the water fill from a hot water supply and keep the drain open to exhaust the incoming water until such time as the incoming water becomes hot, following which the drain may be closed manually and the washing operation started. If the water supply is some distance away from the washer, it may take a minute or so for the water to become sufficiently hot. This method, therefore, requires the time and attention of the operator but there is no assurance that the operator will follow the recommended procedure. To avoid the inconvenience to an operator of having to monitor the incoming water temperature, it is therefore desirable to control the washer automatically with respect to the fill water temperature.

SUMMARY OF THE INVENTION

Apparatus constructed in accordance with the invention is adapted for use in a washer having a hot water reservoir, a drain for the reservoir, a stopper for the drain, a hot water inlet for filling the reservoir, and means for controlling the filling of the reservoir with hot water. The control means includes a valve for admitting water through the hot water inlet, an actuator for the stopper, temperature sensing means for sensing the temperature of the water flowing through the hot water inlet, and means coupled to the valve, the actuator, and the temperature sensing means for opening the valve means to admit water. The control means is responsive to the temperature sensing means for closing the stopper when the water temperature reaches a selected value.

THE DRAWINGS

Apparatus constructed in accordance with a preferred embodiment of the invention is disclosed in the accompanying drawings wherein.

DESCRIPTION OF THE INVENTION

Figure 1:
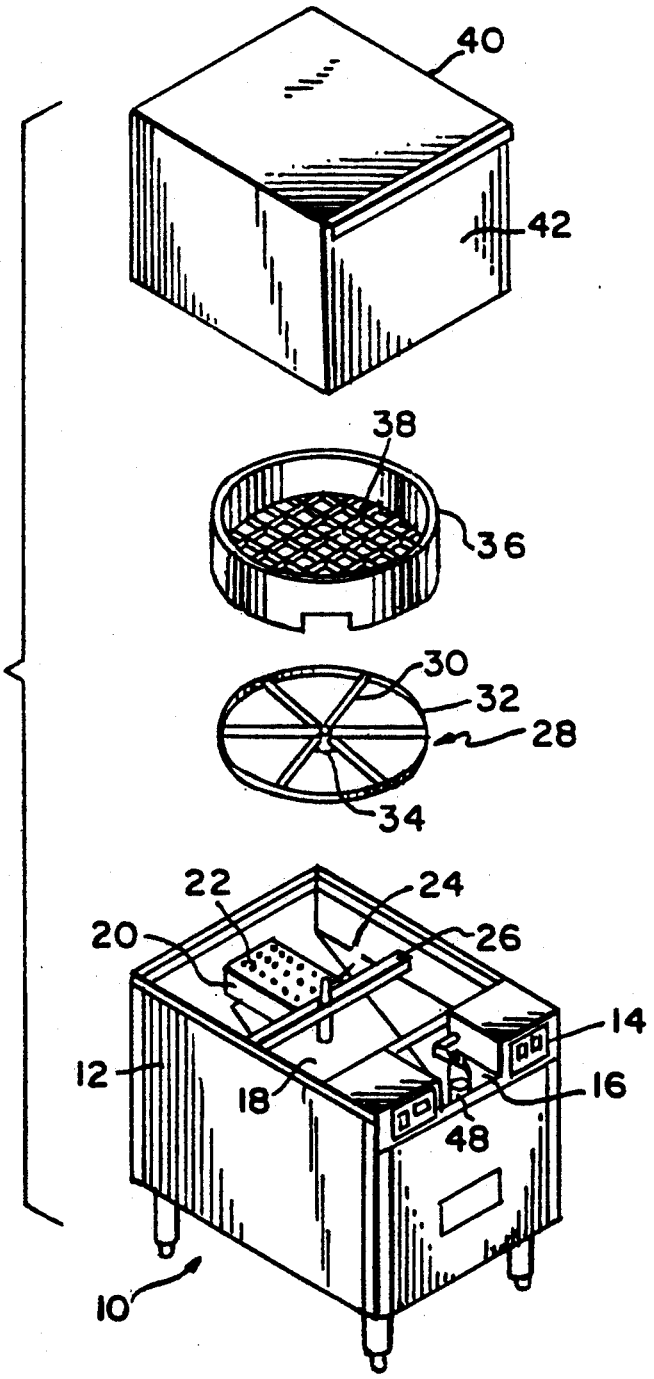
FIG. 1 is an exploded isometric view of the glass washer apparatus.

The ensuing description of a dish washer specifically relates to a glass washer designed for use in bars. As such, the apparatus is compact and may be set up for rapid, efficient cleansing of glasses. It will be appreciated, however, that the apparatus may take other forms without departing from the principles of the invention.

The disclosed glass washer 10 includes a cabinet 12 having a control panel 14 at the front. The control panel 14 is divided into left and right portions separated by a tank or reservoir 16 between the panel portions. To the rear of the reservoir 16, a drain surface 18 slopes downwardly and forwardly to discharge water into the reservoir. The drain surface 18 is located well below the top of the cabinet 12.

A spray box 20 on the drain surface at the rear thereof is coupled to a recirculation pump (not shown) which fills the spray box 20 with water under pressure to spray water upwardly through nozzles 22 in the top surface of the box.

A vertical spindle 24, driven by a motor (not shown) beneath the drain surface 18 extends upwardly, therethrough and is supported by a cross bar 26 which extends from one side of the cabinet 12 to the other. A drive wheel 28 comprising open spokes 30 and a rim 32 has a central hub 34 for driving support by the spindle 24. A glass rack 36 sized to fit on the drive wheel 28 has a perforated bottom 38 to hold glasses and allow water spray from the spray box 20 to impinge onto the glasses. An open bottom, box-shaped cover 40 removably rests on the cabinet 12 to contain the water spray. A door 42 in the front of the cover 40 allows loading and unloading of the rack 36.

Figure 2:
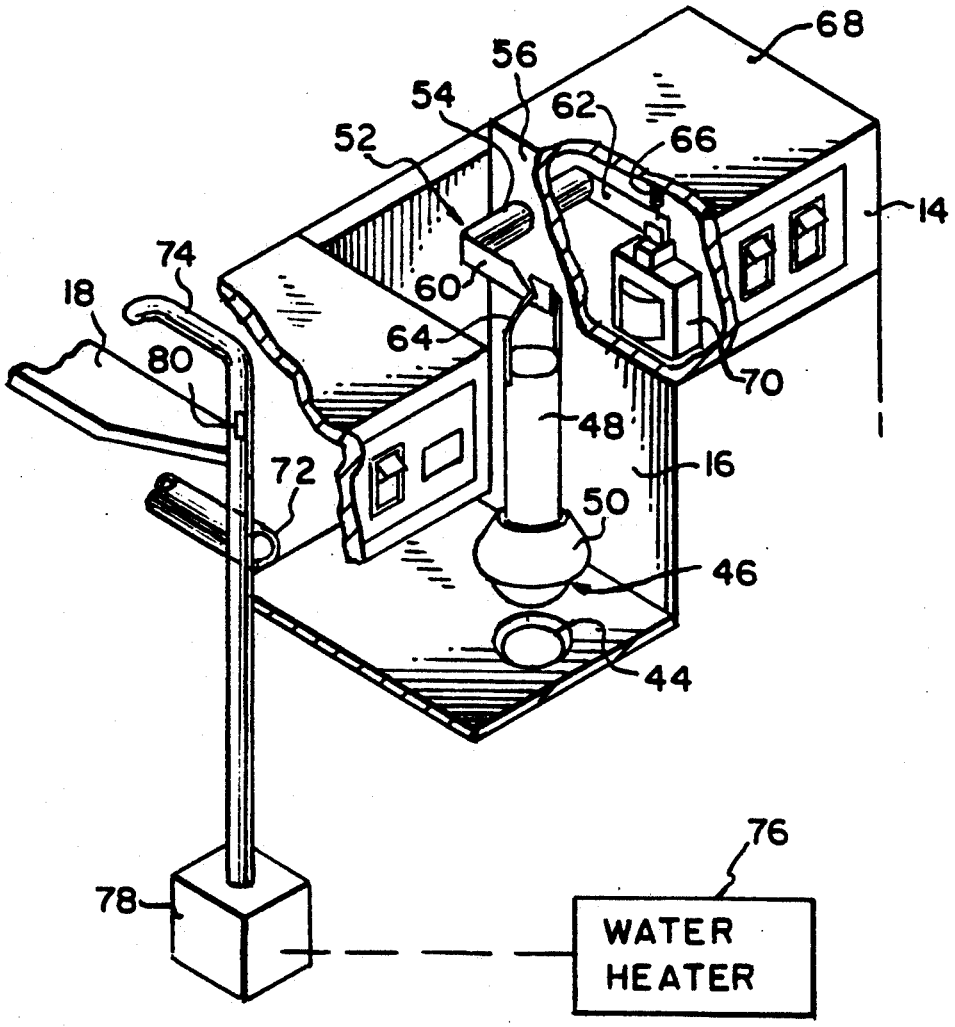
FIG. 2 is a fragmentary, isometric view of a portion of the glass washer according to FIG. 1.
Figure 3:
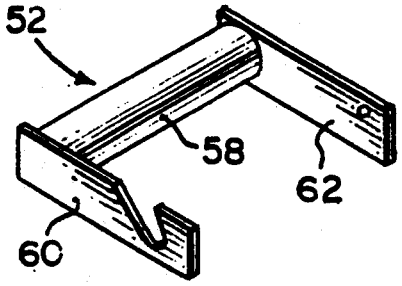
FIG. 3 is a detail view of a part of the apparatus shown in FIG. 2.

FIG. 2 better illustrates the reservoir 16. A drain opening 44 in the bottom of the reservoir 16 underlies and registers with a plunger 46 comprising an elongated vertical body 48 having a rubbery stopper 50 on its lower end. As shown in FIG. 2 the stopper is poised in its open position just above the drain opening 44. A U-shaped arm 52 is rotatably supported by a sleeve 54 fixed in a wall 56 of the cabinet. The sleeve extends into the reservoir 16 on one side of the wall 56 and into a space behind the control panel 14 on the other side of the wall 56. The U-shaped arm 52 comprises a rod 58 (shown in FIG. 3) rotatably accommodated within plastic bearings (not shown) in the sleeve 54 and two levers 60 and 62 extending generally horizontally from each end of the rod 58. One lever 60 has its free end vertically aligned above the drain opening 44 and supports the plunger 46 by a bail 64. The other lever 62 extends toward the control panel 14 and has a coil spring 66 attached in tension between the free end of the lever and an upper cabinet surface 68. The spring tension is sufficient to hold the stopper in its open position A plunger solenoid 70 is attached to the free end of the lever 62 and, when actuated, pulls the lever 62 downwardly against the force of the spring 66 to lower the stopper, thereby closing the drain opening.

FIG. 2 also shows the end of a pickup tube 72 which supplies the recirculating pump with water from the reservoir 16 and a fill tube 74 which carries water into the washer from a hot water supply 76. The fill tube is formed of thermally conductive material and is arranged to discharge water onto the drain surface 18 for flow into the reservoir 16.

A solenoid controlled fill valve 78 is positioned in the fill tube line for controlling the flow of the fill water. A temperature sensor 80 is secured to the outer surface of the fill tube 74 in thermal contact therewith for measuring the temperature of the incoming water.

Figure 4:
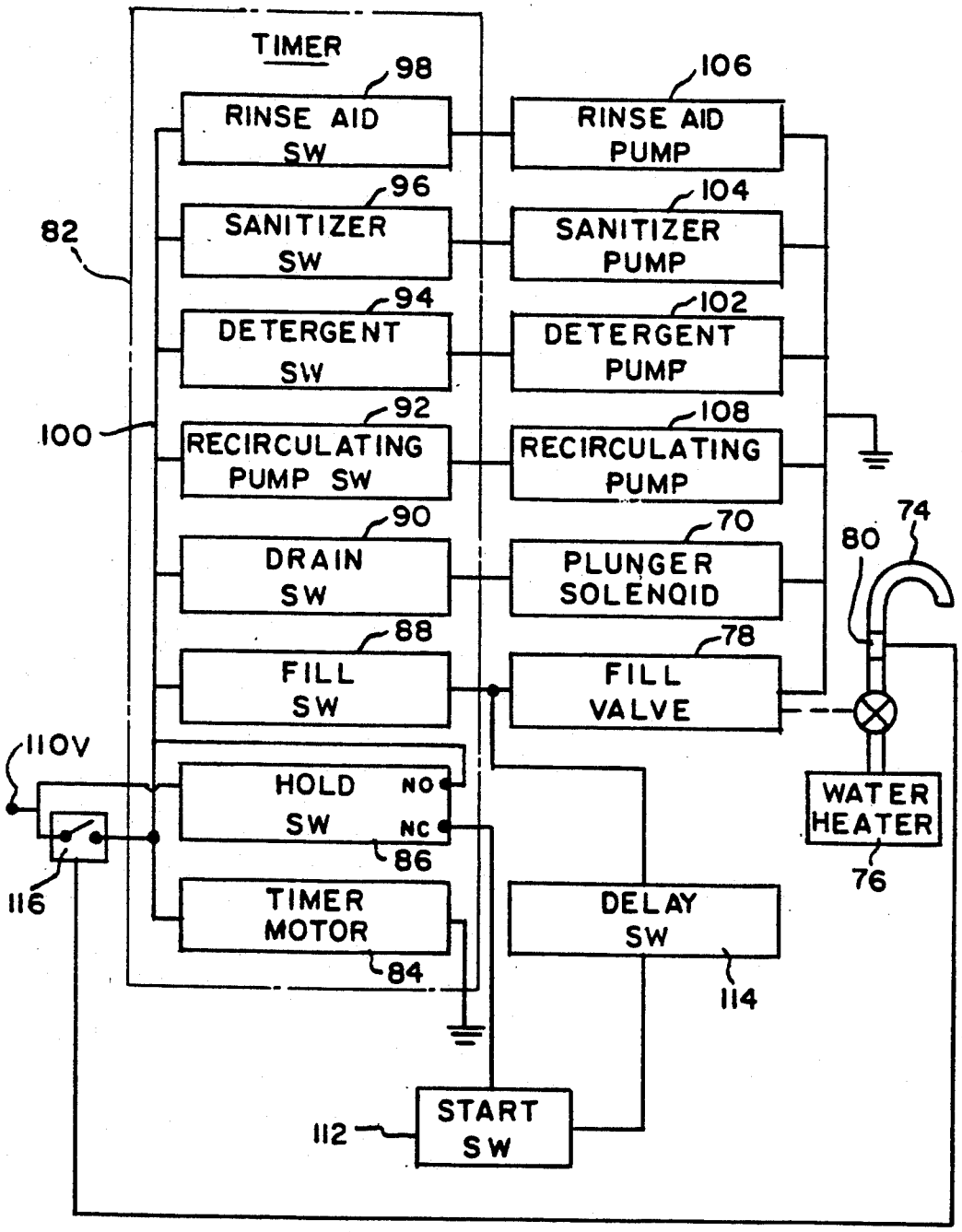
FIG. 4 is a schematic diagram of an electrical control system for the glass washer.

The water fill valve 78, the plunger solenoid 70, and the remainder of the glass washer functions are managed by the control circuit shown in FIG. 4. A timer 82 driven by a timer motor 84 has a hold switch 86, a fill switch 88, a drain switch 90, a recirculating pump switch 92, a detergent switch 94, a sanitizer switch 96, and a rinse aid switch 98 which are actuated in predetermined sequence as the timer motor runs through its cycle. All the switches are connected to a 110 volt line 100 which is energized only when the timer motor 84 is turned on. The detergent, sanitizer, and rinse aid switches 94, 96, and 98 are connected to respective pumps 102, 104, and 106 which meter the appropriate chemical into the wash or rinse water when energized. The recirculating pump switch 92 is connected to the recirculating pump 108 to pump water through the spray box 22 when the switch 92 is closed by the timer. The drain switch 90 is connected to the plunger solenoid 70 to close the drain opening 44 when the drain switch is closed. The fill switch 88 is connected to the fill valve 78 to turn on the water supply when the fill switch is closed. The hold switch 86 has normally open (NO) contacts connected between the 110 volt main line and the 110 volt internal line 100. The NO contacts close when the timer motor is energized and latches the voltage onto line 100 until the timer motor completes its cycle. The hold switch 86 also has normally closed (NC) contacts which energize an output when the timer motor is not energized.

A manually operable start switch 112 and a two minute delay timer 114 are serially connected between the normally closed contacts of the hold switch 86 and the fill valve 78 to turn on the fill valve when the start switch 112 is closed. A thermostat switch 116, coupled to the temperature sensor 80 and closed when the sensor 80 is heated above a selected temperature, is connected between the main 110 volt line and the line 100.

In operation, the hold switch 86 initially applies voltage to the start switch 112 and the line 100 has no voltage applied. When the start switch 112 is manually closed, the fill valve 78 is actuated to allow water flow through the fill tube 74. The plunger solenoid is normally off so that the drain 44 is open to discharge any water as it flows into the reservoir 16. If the water does not become hot within two minutes, the delay timer 114 opens the circuit to close the fill valve 78, thereby guarding against running the water for an indefinite time. Normally, however, the water will become hot within about a minute.

When a selected water temperature is sensed by the sensor 80 the thermostat switch 116 is closed to start the timer motor 84. The first movement of the timer motor causes the normally open contacts of the hold switch 86 to open and the normally open contacts and the fill switch to close so that the fill valve 78 is energized through the timer 82 while voltage is removed from the start switch 112 and timer 114. At the same time the drain switch 90 is closed to activate the plunger solenoid 70 and close the drain opening 44, thereby enabling retention of the hot water which is flowing into the reservoir. Thus the operator need not attend the washer after pressing the start switch 112. The machine controls ensure that if hot water is available the reservoir will start to fill as soon as the running water becomes hot, and in the event hot water is not available, the water will be turned off after two minutes.

What is claimed is:

1. Apparatus for enabling the filling of a reservoir with incoming water at a predetermined minimum temperature, said apparatus comprising valve means movable between positions in which incoming water is enabled and disabled to flow to said reservoir; a drain opening in said reservoir; a closure for said drain opening movable between drain opened and drain closed positions; means for maintaining said closure in said drain opened position when the temperature of the incoming water is less that said minimum temperature thereby enabling incoming water to flow out of said reservoir through said drain opening; operating means for moving said closure from said drain opened position to said drain closed position; means for sensing the temperature of the incoming water; means coupling said sensing means and said operating means for actuating said operating means and effecting movement of said closure to said drain closed position in response to said sensing means sensing said predetermined minimum temperature of said incoming water, thereby enabling said reservoir to be filled with said incoming water, and timer means coupled to said valve means for moving the latter to its disabled position if the temperature of said incoming water is lower than said predetermined minimum temperature after a predetermined time period.

2. In a dishwashing apparatus having a cabinet, a water reservoir in said cabinet, a water inlet for delivering incoming water to said reservoir, a drain opening in said reservoir for draining water therefrom, a closure for opening and closing said drain opening, dish supporting means in said cabinet, and spray means for spraying dishes on said supporting means with water from said reservoir, the improvement comprising:

(a) valve means for controlling the flow of incoming water from a source thereof through said inlet;

(b) temperature sensing means for sensing the temperature of incoming water flowing through said inlet;

(c) means mounting said closure for movements between first and second positions in which said closure respectively opens and closes said drain opening;

(d) means maintaining said closure in said first position when the temperature of incoming water is lower than a predetermined minimum, thereby enabling water delivered to said reservoir at a temperature lower than said predetermined temperature to be discharged through said drain opening;

(e) operating means for moving said closure between said positions;

(f) control means coupling said temperature sensing means and said operating means, said control means being operable to actuate said operating means in response to said sensing means sensing a rise in the temperature of said incoming water to said predetermined minimum and effect movement of said closure means to said second position, whereby said reservoir may be filled with water at a temperature not less than that of said predetermined minimum; and (g) times means coupled to said valve means for moving the latter to a position in which incoming water is disabled from passing through said inlet if the temperature of said incoming water is lower than said predetermined minimum after a predetermined time interval.

3. Apparatus for filling a reservoir having a drain opening therein with incoming water at a predetermined minimum temperature, said apparatus comprising valve means movable between first and second positions in which said valve means respectively enables and diasables the flow of incoming water from a source thereof to said reservoir; a closure for said drain opening movable between drain opened and drain closed positions; closure support means for supporting said closure in its drain opened position so that incoming water from said source may exit said reservoir via said drain opening; operating means coupled to said closure support means and operable in response to actuation thereof to move said closure to its drain closed position; sensing means for sensing the temperature of incoming water; means coupling said sensing means to said operating means for actuating the latter and effecting movement of said closure to its drain closed position in response to the sensing by said sensing means of said predetermined minimum temperature of said incoming water; and timing means coupling said operating means and said valve means for moving said valve means to its second position if said operating means is not actuated within a predetermined period of time.

* * * * *

UNITED STATES PATENT AND TRADEMARK OFFICE

CERTIFICATE OF CORRECTION

PATENT NO. : 5,137,041

DATED : August 11, 1992

INVENTOR(S) : Jon D. Hall

It is certified that error appears in the above-identified patent and that said Letters Patent is hereby corrected as shown below:

Column 4, line 56, change "times" to -- timer --;

Column 5, line 8, before "incoming" insert -- said --.

Signed and Sealed this

Thirty-first Day of August, 1993

Bruce Lehman

*Attest:*

BRUCE LEHMAN

*Attesting Officer*

*Commissioner of Patents and Trademarks*